United States Patent [19]

Schmiegel

[11] Patent Number: 4,688,292

[45] Date of Patent: Aug. 25, 1987

[54] VACUUM CLEANING APPARATUS

[76] Inventor: Karl-Heinz Schmiegel, Friedensplatz 2, 8025 Unterhaching, Fed. Rep. of Germany

[21] Appl. No.: 887,313

[22] Filed: Jul. 21, 1986

[30] Foreign Application Priority Data

Jul. 23, 1985 [DE] Fed. Rep. of Germany ..... 3526328

[51] Int. Cl.[4] ..... A47L 5/38; A47L 9/28

[52] U.S. Cl. ..... 15/300 A; 15/315; 15/323; 15/339

[58] Field of Search ..... 15/315, 323; 226/118, 226/300 A

[56] References Cited

U.S. PATENT DOCUMENTS

| | | | |
|---|---|---|---|
| 1,896,128 | 2/1933 | Thompson | 15/315 |
| 2,023,955 | 12/1935 | Harvey | 15/315 |
| 2,051,728 | 8/1936 | Manning | 15/315 X |
| 3,958,297 | 5/1976 | Hukuba et al. | 15/315 |
| 3,977,037 | 8/1976 | Miyake et al. | 15/315 |
| 3,977,038 | 8/1976 | Hukuba et al. | 15/315 X |
| 4,050,113 | 9/1977 | Wright et al. | 15/315 |

*Primary Examiner*—Chris K. Moore

*Attorney, Agent, or Firm*—Townsend & Townsend

[57] ABSTRACT

A vacuum cleaning apparatus has a main suction box (11) with a dirt collecting container (32) and an auxiliary suction box (16) with a flexible hose (14) laid therein in the form of a loop (15), with the flexible hose being guided outwardly through an opening (17) in the front wall of the housing (36). The flexible hose (14) is automatically drawn in into its position of non-use and is automatically cleaned during this by a depression in the auxiliary suction box (16).

18 Claims, 3 Drawing Figures

VACUUM CLEANING APPARATUS

Figure 1:
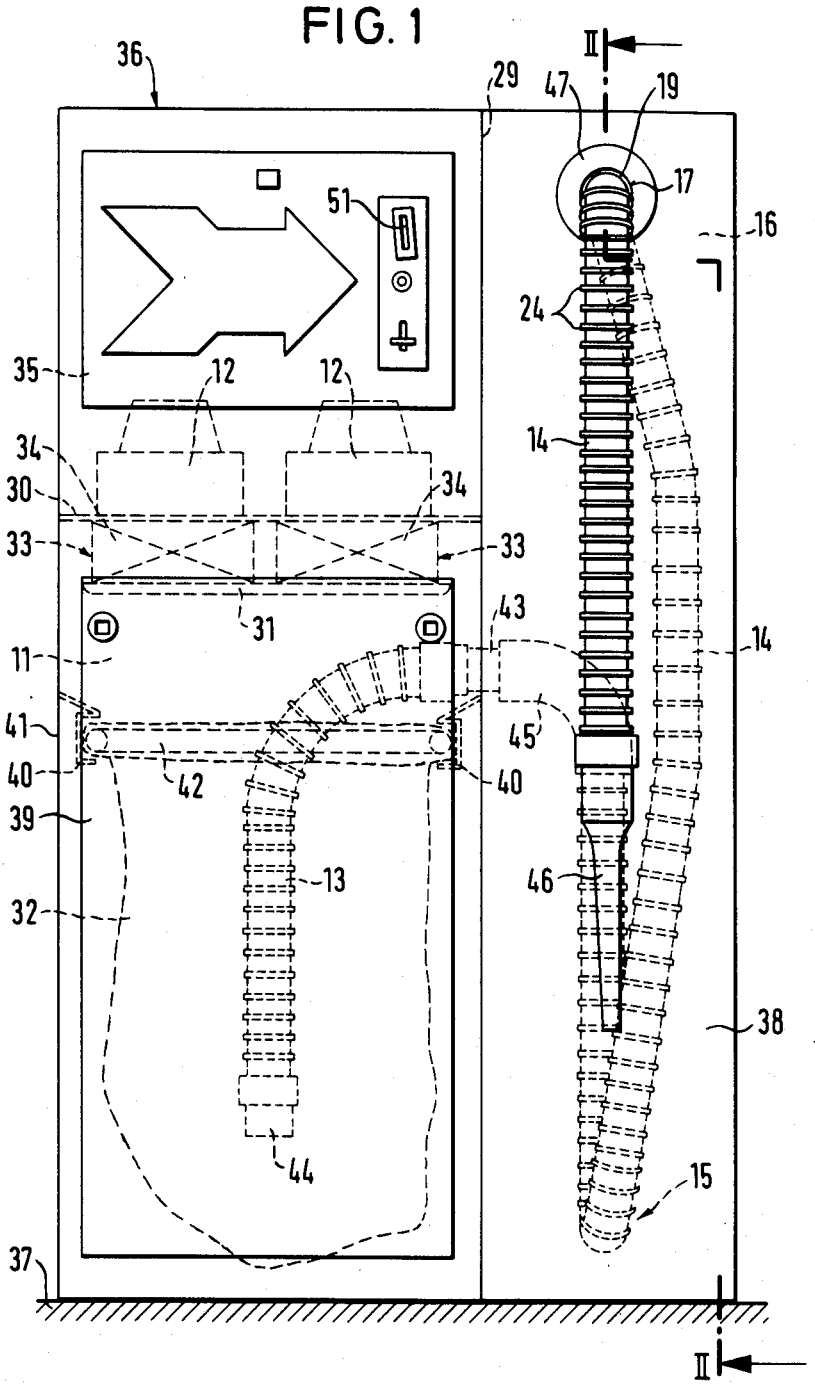

The invention relates to a vacuum cleaning apparatus comprising a main suction box in which a vacuum or depression can be created by at least one main suction source which is capable of being switched on and off, for the purpose of sucking the dust, fluff etc. through a suction duct which is led in sealed manner out of the suction box, wherein a preferably flexible hose is sealingly attached to the outer end of the suction duct, with the suction hose being housed in at least one loop in a storage box from which it is led outwardly through an opening, the edge of which surrounds the outer wall of the hose.

Such vacuum cleaning apparatuses are frequently erected at self-service petrol or gas stations in order to give vehicle owners the possibility of cleaning dust, fluff, dirt etc. from the interior of their vehicle by means of the flexible hose by moving the suction nozzle of the flexible hose over the floor and the seats of the vehicle. With such vacuum cleaning apparatus it is important that the flexible hose is stowed in the non-used position within the housing of the apparatus or outside of it at a suitable position so that it is neither in the way nor liable to become dirty.

It is already known to guide such flexible hoses outside of the housing of the apparatus via a tensioning device which holds the flexible hose in a loop above the housing when not in use. Furthermore, one can provide a rolling device inside the housing onto which the flexible hose can be rolled up after use, for example by means of spring force. On pulling the nozzle of the hose the hose unrolls and emerges in the desired length out of the housing through a guide opening in the front wall of the housing (US-PS 42 46 675).

Furthermore, a vacuum cleaning apparatus with a main suction box is known from which a pipe which sucks in the dust is led into a storage box in which the hose is accommodated while forming a loop. The hose which is provided with a suction nozzle can be drawn out of the storage box to a desired length through an opening in the front wall of the storage box. After use the hose is then pushed through the opening back into the storage box (US-PS 20 51 728).

A considerable problem with such vacuum cleaning apparatus lies in the fact that the hose always becomes dirty when the latter enters into contact with the dirty ground or with dirty regions of a vehicle for example. This then brings the danger that the person using the vacuum cleaner makes his clothing or the interior of the vehicle dirty with the dirty hose. It must also be expected that certain users of the vacuum cleaner will not return the hose back into the storage box, so that there is then an increased danger of the hose becoming dirty and also of it being damaged.

The object of the invention is thus to provide a vacuum cleaner of the initially named kind in which the flexible hose is automatically drawn after use into a chamber which is completely protected from the outside while automatic cleaning of the region of the hose which enters into the housing of the apparatus however simultaneously takes place.

In order to satisfy this object the invention provides that the edge surrounds the outer wall of the hose with a small clearance; and that the storage box is formed as an auxiliary suction box in which a depression can be generated such that the hose can be drawn out of the opening against the depression while the size of the loop decreases, and such that on releasing the hose it can be drawn back into the auxiliary suction box by the depression while the size of the loop increases.

The thought underlying the invention is thus to be seen in the fact that the flexible hose, insofar as its end piece does not continulusly project out of the apparatus, is stowed in a housing which is continuously closed on all sides into which it is sucked automatically by suction, with the sucked in air which enters past the outer wall of the flexible hose at high speed in the region of the ring gap blowing away any dirt or moisture which is present in the region of the outer wall of the flexible hose. Dirt and moisture are then collected on the floor of the auxiliary suction box from where they can be removed from time to time through a suitable door or flap. As all regions of the outer wall of the hose must enter through the opening on sucking the flexible hose into the auxiliary suction box, the hose is completely cleaned once all around its outer wall during each drawing in procedure. A further cleaning process takes place on pulling out the hose.

An abutment flange which restricts the size of the loop is expediently provided on the hose. In this way a length of hose which is necessary to enable the hose to be grasped projects beyond the front wall of the vacuum cleaner, but is however so short, that it cannot come into contact with the ground. This hose piece can however fundamentally likewise be arranged fully sunk within the auxiliary suction box so that only the end nozzle of the flexible hose required for vacuum cleaning projects beyond the front wall of the housing of the vacuum cleaner of the invention.

In order that the depression in the auxiliary suction box automatically switches off after the flexible hose has been drawn in fully, a signal generator is provided on the hose in the region of the flange and cooperates with a signal pick-up arranged at the auxiliary suction box adjacent the opening, the signal pick-up being connected via a line to an electrical control circuit by means of which the depression in the auxiliary suction box is switched off when the signal generator is located near to the signal pick-up, or is switched on when the signal generator moves away from the signal pick-up.

In order to make the pressure force which acts on the hose on drawing it in as large as possible, with a predetermined depression in the interior of the auxillary suction box, the hose should have radially projecting peripheral ribs at small longitudinal spacings, with the longitudinal spacings of the peripheral ribs expediently being smaller than the axial length of the opening. In this way ring surfaces which extend substantially perpendicular to the axis of the hose are provided in the region of the opening on which the differential pressure between the atmosphere and the interior of the auxiliary suction box can act, in the sense that the flexible hose is driven into the interior of the auxiliary suction box.

In accordance with a first embodiment the depression in the auxiliary suction box can be generated by an auxiliary suction source.

As however the main suction source and the auxiliary suction source for the auxiliary suction box normally never operate at the same time the depression in the auxiliary suction box can, in accordance with a specially preferred embodiment, be generated by the main suction source in as much as the depression is switched off from the main suction box and applied to the auxiliary suction box via a valve arrangement.

In this arrangement the main suction turbines which are provided for removing the dirt are simultaneously also used to draw in the flexible hose by means of sub-atomospheric pressure.

An advantageous practical embodiment is characterised in that a preferably vertical intermediate wall is provided between the main suction box and the auxillary suction box, with the suction duct passing through the intermediate wall preferably at the mid-height.

A further expedient embodiment is so constructed that a preferably horizontal transverse wall is sealingly arranged above the main suction box with at least one main suction turbine being arranged in the horizontal transverse wall as the main suction source.

This arrangement should in particular be such that the control circuit and other actuating elements are also arranged above the transverse wall.

A further development of the invention which is important for a compact arrangement is characterised in that an auxiliary suction turbine is arranged as the auxiliary suction source above the transverse wall in the intermediate wall.

With such vacuum cleaning apparatus the problem also exists that the dirt sucked into the main suction box can pass, at least in part, to the intake openings of the main suction turbine. For this reason filters are provided here. Thes filters can however become rapidly blocked if too much of the dirt that is sucked in reaches the filters in fron of the suction turbine intakes rather than falling into the dirt collection container arranged in the main suction box.

The invention also seeks to provide assistance in this respect, in that measures are taken to ensure that the largest part of the dirt that is sucked in falls into the dirt collection container and that as little dirt or dust as possible reaches the filters, which in other respects should be made to have as large an area as is possible.

In order to satisfy this further object the invention provides, in a vacuum cleaning apparatus of the initially named kind, that a preferably horizontally extending impingement plate which extends on all sides beyond the suction openings is provided below and vertically spaced from the main suction turbine(s), with an open dust collecting container into which the suction dust opens from above being arranged below the impingement plate.

With this arrangement ring filter packs should be sealingly arranged between the transverse wall containing the main suction turbine(s) and the impingement plate.

The arrangement is preferably such that the ring filter packs sealingly contact the transverse wall and the impingement plate with their upper and lower edges respectively. In particular the ring filter packs should be of rectangular or round shape.

In order to provide a particularly large filter surface it is expedient if the wall extending around each ring filter pack consists of filter material which is folded in concertina-like manner and/or of filter material provided with folded filter pockets.

Because the suction duct has a comparatively small cross-section corresponding approximately to that of the flexible hose the outlet speed of the dirt-air flow within the dirt collecting container is relatively large, however a certain expansion takes place as a result of the comparatively large diameter of the dirt collection container and this greatly and abruptly slows down the air current which is emerging upwardly out of the dirt collection container, so that only a little dirt is moved upwardly with it. This dirt however impinges from below against the impingement plate as a result of its slow straight line movement, and is thus reflected back in the direction of the dirt collecting container. The air is however deflected around the impingement plate and enters sideways around the impingement plate into the wall-like filters after a substantial separation of dirt and air has already taken place. Rapid blocking of the filter, as a result of entrained dust, is effectively avoided by the relatively large filter surface.

Such vacuum cleaning apparatuses in self-service gas stations are generally switched on by insertion of a coin. On doing so the control circuit first sets the main suction turbines in operation for a specific period. The operator can now pull the hose out of the suction box and carry out the desired cleaning work. After the expiry of the preset suction time the main suction turbines switch off and the auxiliary suction tubine is simultaneously switched on. When the operator now releases the hose it will be automatically sucked into the auxiliary suction box with the loop forming and dirt and dust etc. being removed from the wall of the hose. The sucking in of the hose proceeds until the flange provided thereon abuts against the front wall of the housing adjacent the suction opening, whereupon the signal generator in conjunction with the signal pick-up brings about the switching off of the auxiliary suction turbine via the control circuit.

A preferred embodiment of the invention thus consists in the control circuit switching off the depression in the auxiliary suction box when the main suction turbines are switched on and switching on the depression in the auxiliary suction box when the main suction turbines are switched off, providing the signal generator and the signal pick-up are remote from one another.

In order to exploit the height of the apparatus to accommodate the flexible hose when not in use to the fullest degree a preferred practical embodiment is characterised in that the auxiliary suction box extends alongside the main suction box and the accommodation space arranged above it over the whole height of the apparatus.

The hose can be accommodated in a simple loop within the auxiliary suction box. It is however fundamentally also possible to form the loop by rolling up of the hose if larger extractable hose length are desired.

Figure 2:
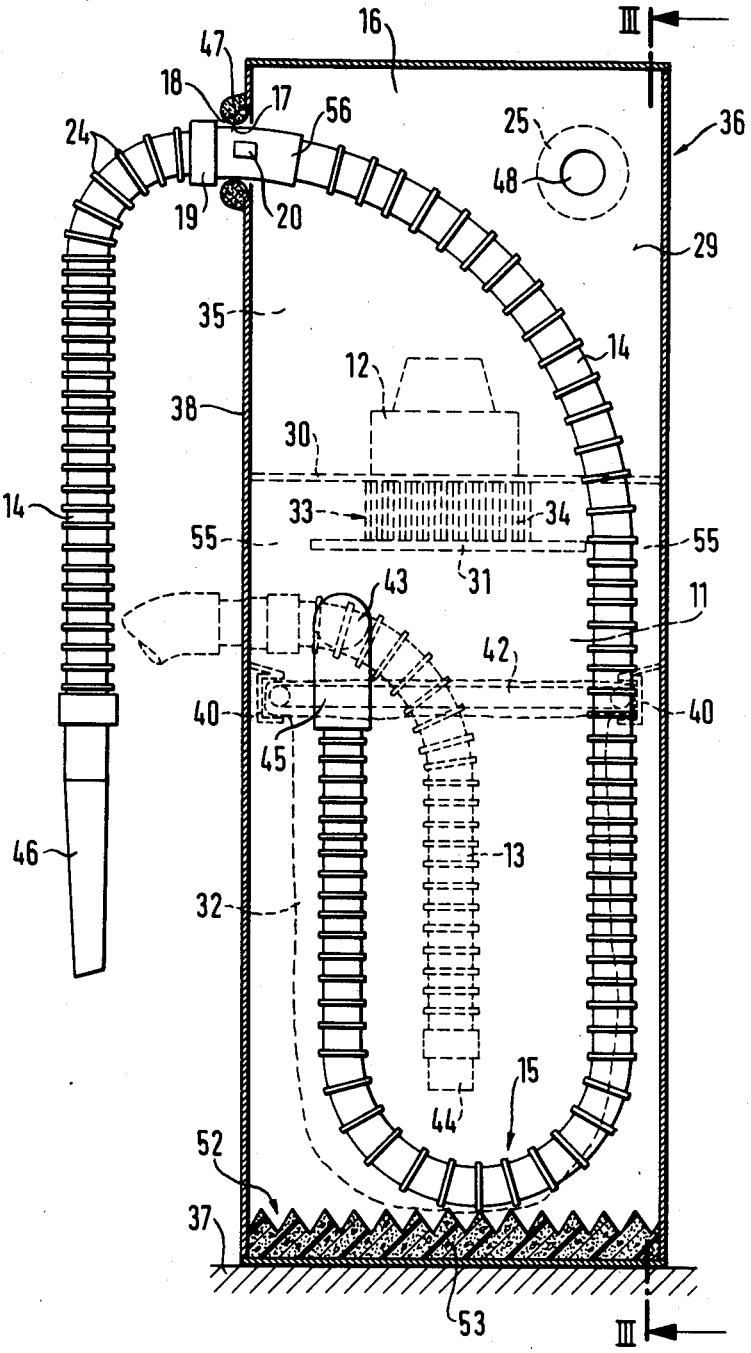
Figure 3:
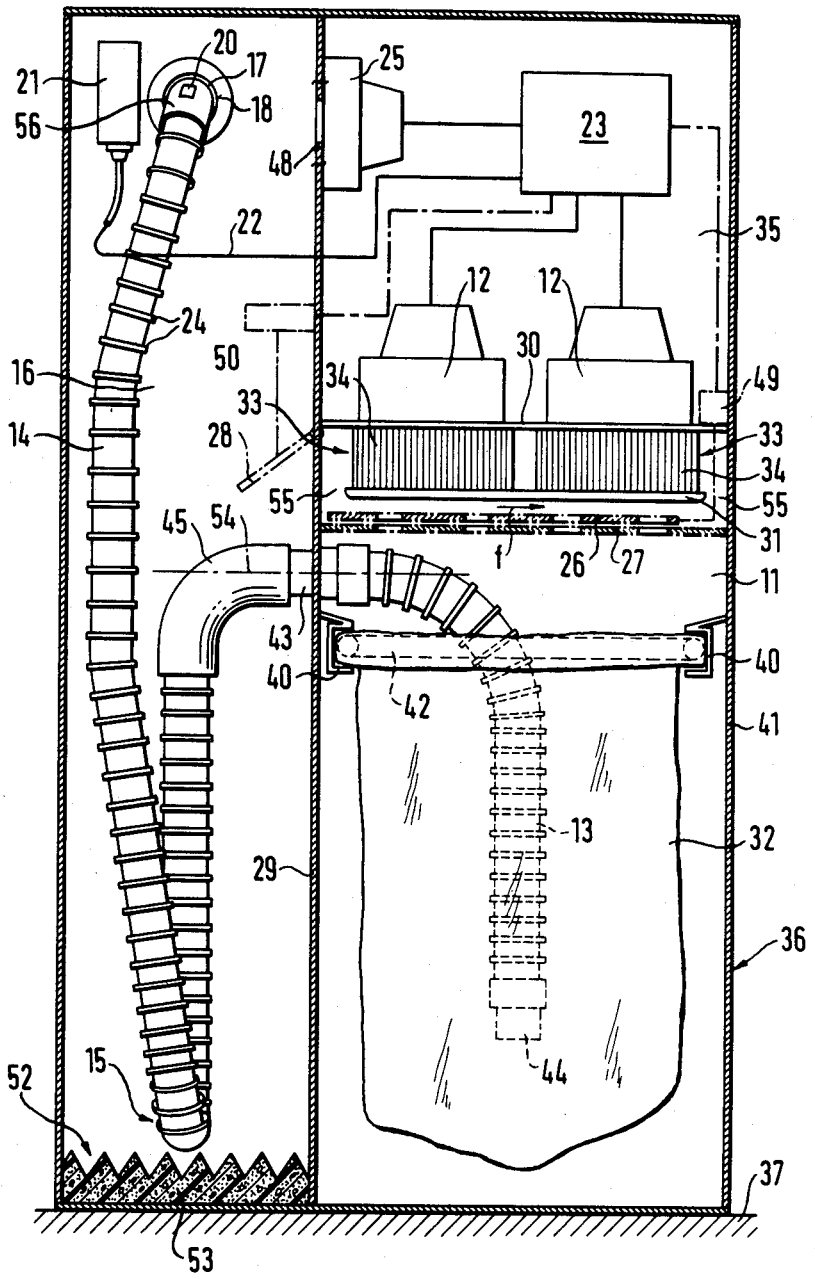

The invention will now be described in the following by way of example only and with reference to the drawings in which are shown:

FIG. 1 a schematic front view of a self-service vacuum cleaning apparatus in accordance with the invention with the components located behind the front wall of the housing being indicated in broken lines, FIG. 2 a schematic view on the line II—II of FIG. 1 with the parts behind the intermediate wall which are not immediately visible likewise being schematically illustrated in broken lines, and FIG. 3 a schematic section on the line III—III of FIG. 2.

In accordance with the drawing the vacuum cleaning apparatus of the invention is accommodated in a plastic or sheet metal housing 36 having the shape of a parallelapiped which stands at its base on the floor 37 of a self-service gas station. The front wall 38 of the housing 36 has its left-hand region in FIG. 1 a removable rectangular flap 39 which extends vertically over approximately half the height of the housing 36 and the width of which is greater than the width of the housing 36. Behind the removable flap 39 there is a holding apparatus 40 for a dirt collection container 32 of sack-like construction. The holding device 40 is mounted, in accordance with FIGS. 1 to 3, at approximately mid-height of the housing 36 on the one hand on the lefthand sidewall 41 in FIG. 1 and on the other hand on a vertical intermediate wall 29 of the housing 36. A tensioning frame 42 which holds the dirt collecting container 32 open engages into the holding device 40.

It is important, that the dirt collecting container 32 is open at the top with a sufficiently large area that the air stream which emerges there in the upward direction only has a low vertical speed.

A stub 43 forming a passage through the intermediate wall is located at approximately the mid-height of the intermediate wall 29 in its front region. A downwardly curved suction hose 13 is joined to this stub and points towards the dirt collecting container 32. The outlet end 44 of the hose 13 opens well down within the dirt collecting container 32.

A horizontally extending flat impingement plate 31 is secured above the dirt collecting container 32 and the stub 43 in non-illustrated manner and broad air gaps 55 are provided around and adjacent the impingement plate 31.

A transverse wall 30 which extends between the intermediate wall 29 and the sidewall 41 is located at a vertical distance above the impingement plate 31 and subdivides the housing 36 into a lower main suction box 11 and into an upper accommodation chamber 35 for various actuation and drive elements. Two main suction turbines 12 are built alongside one another into the transverse wall 30 and their suction openings (which are not illustrated), are surrounded by ring filter packs 33 which consist in the illustrated manner of folded filter material. At the top the ring filter packs 33 sealingly contact the transvese wall 30 from below and there surround the non-illustrated suction openings of the main suction turbines 12. At the bottom the ring filter packs 33 sealingly contact the top side of the impingement plate 31. The air sucked in by the main suction turbines 12 is thus forced through the broad ring gap 55 onto the large area folded outer wall of the ring filter pack 34. The filtered air is then blown outwardly by the main suction turbines 12 in non-illustrated manner.

The suction duct 13 which is preferably constructed as a flexible hose passes, after connection to the through guiding step 43 and a pipe bend 45 which is angled downwardly through 90°, into a flexible hose 14 which, in the state illustrated in the figures, is led in the form of a loop 15 first of all from the pipe bend 45 downwardly and then finally upwardly up to a circular passage opening 17 provided in the front wall of the housing where it passes through the front wall from the inside to the outside and then hangs vertically downwardly in the manner which can be seen from FIGS. 1 and 2. A suction nozzle or stub 46 is secured to the outer end of the flexible hose 14. Peripheral ribs 24 are provided around the flexible hose at relatively small longitudinal intervals.

The flexible hose 24 has an abutment flange 19 around it at a relatively small distnace from the suction nozzle 46 and the flange is continued in the direction of the hose 15 by a shrinkable sleeve piece 56 within which a signal generator 20 which is made as shallow as possible and which can for example be a magnetic platelet or a metallic platelet is housed.

The material 47 around the opening 17 has a certain extent in the axial direction as seen in FIG. 2 which should be greater than the longitudinal spacing of the peripheral ribs 24.

The dimensioning of the diameter of the opening 17 is so selected that a small degree of clearance exists between the peripheral ribs, or the shrunk on hose 56, and the edge 18 of the opening 17.

The left hand region of the housing 36 as seen in FIG. 1 forms an auxiliary suction box 16 which is sealed in air-tight manner on all sides apart from the opening 17 and which can be placed at sub-atmospheric pressure by an auxiliary suction turbine 25 which is mounted onto the intermediate wall 29 at the top right hand side in FIG. 2. The auxiliary suction turbine 25 is connected by a bore 48 to the auxillary suction box 16.

As seen in FIG. 3 a signal pick-up 21 is located alongside the passage opening 17 in the vicinity of the signal generator 20 and can be constructed as a switch which responds to a metal platelet or to a magnetic platelet in its immediate vicinity, for example a reed switch. The signal pick-up 21 is connected via a line 22 with a control circuit 23 which is housed in the chamber 35 above the main suction turbines 12. The control circuit 23 also switches the main suction turbines 12 and the auxiliary suction turbine 25. A further embodiment is also indicated in broken lines in FIG. 3 in which the main suction turbines 12 are also exploited to generate the depression in the auxiliary suction box 16, whereby the auxiliary suction turbine 25 is no longer needed.

In this embodiment an apertured sheet metal plate 27 can be arranged beneath the impingement plate 31 which extends over the entire horizontal cross-sectional area of the main suction box 11. Above it there is located an apertured slide gate 26 which, in the illustrated position, makes the passage of air upwardly from beneath possible. If, however, the aperture slide gate 26 is displaced by an actuating device 49 in the direction of the arrow f in FIG. 3 then the holes of the apertured sheet metal 27 and of the apertured slide gate 26 move out of alignment, which leads to an air-tight closure between the auxiliary suction box 11 and the space above the apertured slide gate 26. At the same time a further actuating device 50 is excited by the control circuit 23 which opens a flap 28 provided in the intermediate wall 29 and thus produces a flow connection between the main suction turbine 12 and the auxiliary suction box 16. The control circuit 23 controls the flap on the one hand the apertured slide 26 on the other hand in such a way that the main suction turbines 12 are connected either to the main suction box 11 or to the auxiliary suction box 16.

The manner of operation of the described vacuum cleaning apparatus is a follows:

When a user wishes to vacuum out his vehicle he first pushes a coin into the slot 51 provided for this purpose in the upper part of the front wall of the housing 36 (FIG. 1). This causes the control circuit 23 to set the main suction turbines 12 into operation. The user now grasps the flexible hose 14, preferably in the vicinity of the suction nozzle 46, and pulls the required length of hose out of the auxiliary suction box 16. He can now comfortably clean his vehicle of dirt, dust etc. in the desired manner.

As soon as the preselected suction cycle is terminated by a timing circuit provided in the control circuit 23 the control circuit 23 switches the main suction turbines 12 off and simultaneously switches on the auxiliary suction turbine 25. As an alternative the aperture slide gate 26 can be moved into the closed position and the flap 28 into the open position, in which case the main suction turbines 12 would continue to run.

The vacuuming procedure is now terminated and the depression built up in the auxiliary suction box 16 automatically sucks the flexible hose 14 back through the passage opening 17 into the interior of the auxiliary suction box 16 where the loop 15 forms. Each region of the flexible hose 14 located in the passage opening 17 is cleaned as a result of the accelerated air which passes through the ring gap. Any dust which is swept away during this procedure falls onto the bottom 52 of the auxiliary suction box 16 from where it can be removed from time to time through a non-illustrated flap.

A foam body 53 provided with deep grooves is preferably provided on the base 52 as seen in FIG. 3, with the grooves being sufficiently narrow and deep that the dust and dirt swept off from the hose 14 can be correct therein but such that the hose 14 which lies on the floor 52 cannot again come into contact with the dust collected in the grooves, which could otherwise lead to the hose becoming dirty again. In this manner the lower through-hanging loop 15 of the flexible hose 14 can come into contact with the base 52. The sucking in of the flexible hose 14 proceeds until the flange 19, contacts the front wall of the housing. In so doing the signal generator 20 switches off the auxiliary suction turbine 25, of the main suction turbine 12, via the signal generator 21 and the control circuit 23.

A pre-filter which is not shown is located in the region of the intake opening 48 of the auxiliary turbine 25. The pressure generated by the auxiliary turbine 25 is approximately 140 mm water column.

The signal generator 20 and the signal pick-up 21 can expediently take form of inductive proximity switches.

The edge 18 which surrounds the inlet openings 17 is expediently constructed as a teflon nozzle.

The hose 14 is guided with as little play as possible through the passage opening 17 with the clearance however being made sufficiently large that the flexible hose 14 does not remain stuck in the opening when it is being sucked in or being drawn out.

In order to ensure troublefree loop formation the outlet opening 17 should be provided, as far as possible, at the top in the front wall of the housing 36, whereas the transition stub 43 for the connection of the suction duct 13 should be arranged right at the front and as high as possible on the intermediate wall 29. It is most expedient when the suction duct 13 opens directly above the holding device 40 for the dirt collecting container 32. In order to ensure that the flexible hose can be drawn out as completely as possible, the pipe bend 45 can be pivotable about the horizontal axis 45 common to the connection stub 43. Furthermore, it is expedient if the hose has only a single loop 15 in the drawn in state from its entry end to its outlet end which ensures that it can be drawn in effortlessly.

The auxiliary suction turbine 25 is expediently switched only by the switching device 20, 21 so that it continuously runs when the hose is drawn out, i.e. also when the main suction turbines 12 are switched on. In this way the length which is drawn out is automatically adapted to meet the requirement.

I claim:

1. A vacuum cleaning apparatus comprising a main suction box in which a vacuum or depression can be created by at least one main suction source which is capable of being switched on and off for the purpose of sucking in dust, fluff etc. through a suction duct which is led in sealed manner out of the suction box, wherein a preferably flexible hose is sealingly attached to the outer end of the suction duct, with the suction hose being housed in at least one loop in a storage box from which it is led outwardly through an opening, the edge of which surrounds the outer wall of the hose, characterised in that the edge (18) surrounds the outer wall of the hose (14) with a small clearance (17); and in that the storage box is formed as an auxiliary suction box (16) in which a depression can be generated such that the hose (14) can be drawn out of the opening against the depression while the size of the loop decreases and such that on releasing the hose it can be drawn back into the auxiliary suction box by the depression while the size of the loop increases.

2. A vacuum cleaning apparatus in accordance with claim 1, characterised in that an abutment flange (19) which restricts the size of the loop (15) is provided on the hose (14).

3. A vacuum cleaning apparatus in accordance with claims 2, characterised in that signal generator (20) is provided on the hose (14) and cooperates with a signal pick-up (21) arranged at the auxiliary suction box adjacent the opening (17) , the signal pick-up being connected via a line (22) to an electrical control circuit (23) by means of which the depression in the auxiliary suction box (16) is switched off when the signal generator (20) is located near to the signal pick-up (21), or is switched on when the signal operator (20) moves away from the signal pick-up (21).

4. A vacuum cleaning apparatus in accordance with claim 3, characterised in that the control circuit (23) switches off the depression in the auxiliary suction box (16) when the main suction turbines (12) are switched on and switches on the depression in the auxiliary suction box (16) when the main suction turbines (12) are switched off, providing the signal generator (20) and the signal pick-up (21) are remote from one another.

5. A vacuum cleaning apparatus in accordance with claim 1, characterised in that the hose (14) has radially projecting peripheral ribs (24) at small longitudinal spacings.

6. A vacuum cleaning apparatus in accordance with claim 5, characterised in that the longitudinal spacings of the peripheral ribs (24) are smaller than the axial length of the opening (17).

7. A vacuum cleaning apparatus in accordance with claim 1, characterised in that the depression in the auxiliary suction box (16) is generated by an auxiliary suction source (25).

8. A vacuum cleaning apparatus in accordance with claim 1, characterised in that the depression in the auxiliary suction box (16) is generated by the main suction source (13) in that the depression is switched off from the main suction box (11) and is applied to the auxiliary suction box (16) through a valve arrangement (26, 27, 28).

9. A vacuum cleaning apparatus in accordance with claim 1, characterised in that a preferably vertical intermediate wall (29) is provided between the main suction box (11) and the auxiliary suction box (16) with the suction duct (13) opening in the intermediate wall preferably at mid-height.

10. A vacuum cleaning apparatus in accordance with claim 1, characterised in that a preferably horizontal transverse wall (30) in which at least one main suction turbine (12) is arranged as the main suction source is sealingly arranged above the main suction box (11).

11. A vacuum cleaning apparatus in accordance with claim 10, characterised in that the control circuit (23) and other actuating elements are also arranged above the transverse wall (30).

12. A vacuum cleaning apparatus in accordance with claim 10, characterised in that an auxiliary suction turbine (25) is arranged above the transverse wall (30) in an intermediate wall (29) provided between the main suctin box and the auxiliay suction box.

13. A vacuum cleaning apparatus, in particular in accordance with claim 1, characterised in that a preferably horizontally extending impingement plate (31) which extends on all sides beyond the suction openings is provided below and vertically spaced from the main suction turbine(s) (12), with an open dust collecting container (32) into which the suction duct (13) opens from above being arranged below the impingement plate (31).

14. A vacuum cleaning apparatus in accordance with claim 13, characterised in that ring filter packs (33) are sealingly arranged between the transverse wall (30) containing the main suction turbine(s) (12) and the impingement plate (31).

15. A vacuum cleaning apparatus in accordance with claim 14, characterised in that the ring filter packs (33) sealingly contact the transverse wall (30) and the impingement plate (31) respectively with their upper and lower edges.

16. A vacuum cleaning apparatus in accordance with claim 14, characterised in that the ring filter packs are substantially rectangular or round in shape.

17. A vacuum cleaning apparatus in accordance with claim 14, characterised in that the wall (34) which extends around each ring filter pack (33) consists of filter material folded in concertina-like manner and/or of filter material provided with folded filter pockets.

18. A vacuum cleaning apparatus in accordance with claim 1, characterised in that the auxiliary suction box extends alongside the main suction box and the accommodation space (34) located above it over the whole height of the apparatus.

* * * * *